US006219302B1

(12) United States Patent
Tanoguchi et al.

(10) Patent No.: US 6,219,302 B1
(45) Date of Patent: Apr. 17, 2001

(54) TIME SIGNAL REPEATER AND TIME CORRECTION SYSTEM USING THE SAME

(75) Inventors: Masahiro Tanoguchi, Tokyo; Kenichi Nemoto, Shiraoka-machi; Shinya Yoshida, Tatebayashi; Shunichi Makuta, Kasukabe; Akinari Takada, Mitaka; Kenji Fujita, Sayama; Masahiro Sase, Fussa, all of (JP)

(73) Assignees: Rhythm Watch Co, Ltd; Citizen Watch Co. Ltd., both of Tokyo (JP)

( * ) Notice: Subject to any disclaimer, the term of this patent is extended or adjusted under 35 U.S.C. 154(b) by 0 days.

(21) Appl. No.: 09/528,294

(22) Filed: Mar. 17, 2000

(30) Foreign Application Priority Data

Mar. 18, 1999 (JP) ..... 11-073644
Sep. 17, 1999 (JP) ..... 11-264488

(51) Int. Cl.[7] ..... G04C 11/02
(52) U.S. Cl. ..... 368/47; 368/187
(58) Field of Search ..... 368/10, 47, 187; 340/310.06, 310.07; 455/73, 78

(56) References Cited

U.S. PATENT DOCUMENTS 4,083,004 * 4/1978 Cohn ..... 325/6
4,210,901 * 7/1980 Whyte et al. ..... 340/31 R

FOREIGN PATENT DOCUMENTS 5333170 12/1993 (JP) .

* cited by examiner

*Primary Examiner*—Vit Miska

(57) ABSTRACT

A time signal repeater enabling a radio correction clock to receive a relayed radio signal without regard as to the position of arrangement and without complicated trouble, including a reception circuit for receiving a standard time radio signal and correcting an internal clock to a time according to the time code included in the received radio signal and a transmission circuit for generating and transmitting time radio signals which have different intensities and include time codes based on the internal clock at a plurality of predetermined times, and a time correction system using the same.

5 Claims, 10 Drawing Sheets

3
S2
20b
2
24
INTEGRATING CIRCUIT
23
RECTIFIER CIRCUIT
22
DETECTION CIRCUIT
21
RF AMPLIFIER
20a
S1
1
29
RF AMPLIFIER
28
c
a
b
S25
25
MICRO COMPUTER
27a
OUTPUT INTENSITY ADJUSING CIRCUIT
27b
OUTPUT INTENSITY ADJUSING CIRCUIT
S26
26
40.00kHz SINE-WAVE OSCILLATOR

TIME SIGNAL REPEATER AND TIME CORRECTION SYSTEM USING THE SAME

BACKGROUND OF THE INVENTION

1. Field of the Invention

The present invention relates to a time signal repeater which relays a radio signal including a time code for a radio correction clock receiving a radio signal to correct its time and to a time correction system using the same.

2. Description of the Related Art

A radio correction clock receives, for example, a standard time radio signal of a long wave (for example, 40 kHz in Japan) transmitting a standard time and corrects the time based on the received radio signal to display the precise time.

This type of radio correction clock has built into it a receiving circuit receiving a standard time radio signal and a control circuit for driving a hand driving system based on the received signal to correct the time. In the radio correction clock, the positions of the hands are corrected to positions according to the time code of the received radio signal.

A radio correction clock exclusively receives the standard time radio signal. There are many cases where it is placed in a location which the radio signal can hardly reach, for example, is in an apartment building or basement, and cannot receive the signal.

In order to eliminate this restriction on the location where the radio correction clock is placed, it has been proposed to provide a time signal repeater for receiving the standard time radio signal and modulating the received time signal by a predetermined carrier and transmitting the modulated signal, and to have the radio correction clock receive the signal transmitted from the repeater to correct the time (see for example Japanese Unexamined Patent Publication (Kokai) No. 5-333170).

Summarizing the problem to be solved by the invention, the above time signal repeater transmits the generated time radio signal with a predetermined field intensity.

When a time signal repeater transmits a time radio signal with a field intensity enabling a radio correction clock set a long distance from the time signal repeater to receive it normally, however, the field intensity of the transmitted time radio signal will be too strong at a radio correction clock set comparatively close to the time signal repeater. As a result, so-called "input saturation" will occur and the radio correction clock may no longer be able to normally receive the time radio signal from the time signal repeater.

In this case, it is necessary to turn a radio correction clock set comparatively close to the time signal repeater in a direction with poor directivity, so complicated trouble is necessary.

SUMMARY OF THE INVENTION

An object of the present invention is to provide a time signal repeater enabling a radio correction clock to receive a relayed radio signal without regard to the place where it is set and without requiring complicated trouble and a time correction system using the same.

According to a first aspect of the present invention, there is provided a time signal repeater which relays a radio signal including a time code for a radio correction clock receiving a standard time radio signal to correct a time, comprising a reception circuit for receiving the standard time radio signal and correcting an internal clock to a time according to the time code included in the received radio signal and a transmission circuit for generating and transmitting time radio signals which respectively have different intensities and include time codes based on the internal clock at a plurality of predetermined times.

According to a second aspect of the present invention, there is provided a time correction system comprising a radio correction clock for receiving a standard time radio signal or a radio signal obtained by relaying the standard time radio signal and correcting a time according to a time code included in the received signal and a time signal repeater which has a reception circuit for receiving the standard time radio signal and correcting an internal clock to a time according to the time code included in the received radio signal and a transmission circuit for generating and transmitting time radio signals which have different intensities and include time codes based on the internal clock at a plurality of predetermined times.

Preferably, in the present invention, the transmission circuit generates and transmits a time radio signal of a first intensity at a first time and generates and transmits a time radio signal of a second intensity at a second time.

Preferably, in the present invention, the radio correction clock decodes the time radio signal of the first intensity transmitted from the time signal repeater at the first time and, when it is possible to obtain time data, corrects a time to a decoded time and does not receive the time radio signal of the second intensity transmitted at the second time, while when it is not possible to obtain time data, does not correct a time, but receives the time radio signal of the second intensity transmitted at the second time.

According to the present invention, a standard time radio signal of a long wave (for example, 40 kHz) having a predetermined format is transmitted from a radio transmission base station.

The standard time radio signal transmitted from the radio transmission base station is received by the time signal repeater and radio correction clock.

In the time signal repeater, the standard time radio signal is received by a reception circuit and an internal clock is corrected to a time according to a time included in the received radio signal.

Whenever any of a plurality of predetermined transmission times arrives, a time radio signal which includes a time code based on the internal clock and has a different intensity is generated and the generated signal is transmitted to the radio correction clock.

For example, at a first time, a time radio signal of a first intensity is generated and transmitted. At a second time after a predetermined time, for example, a time radio signal of a second intensity stronger than the first intensity is generated and transmitted.

In the radio correction clock, the time is corrected according to the time code included in the standard time radio signal or the radio signal transmitted from the signal repeater at the appointed time.

At this time, for example, when it decodes the time radio signal of the first intensity transmitted at the first time from the time signal repeater and is able to obtain the time data, in this case, the radio correction clock being set comparatively close to the time signal repeater, for example positions of its hands are corrected to positions according to the decoded time. In this case, the time radio signal of the second intensity transmitted at the second time is not received.

Alternatively, when it decodes the time radio signal of the first intensity transmitted at the first time from the time signal repeater, but is not able to obtain the time data, the positions of its hands are not corrected and the time radio signal of the second intensity transmitted at the second time is received. In this case, the radio correction clock is set a long distance from the time signal repeater.

It then, for example, decodes the time radio signal of the second intensity and, when it is able to obtain the time data, the positions of hands are corrected to positions according to the decoded time.

BRIEF DESCRIPTION OF THE DRAWINGS

These and other objects and features of the present invention will become clearer from the following description of the preferred embodiments given with reference to the accompanying drawings, in which.

DESCRIPTION OF THE PREFERRED EMBODIMENTS

Below, preferred embodiments will be described with reference to the accompanying drawings.

Figure 1:
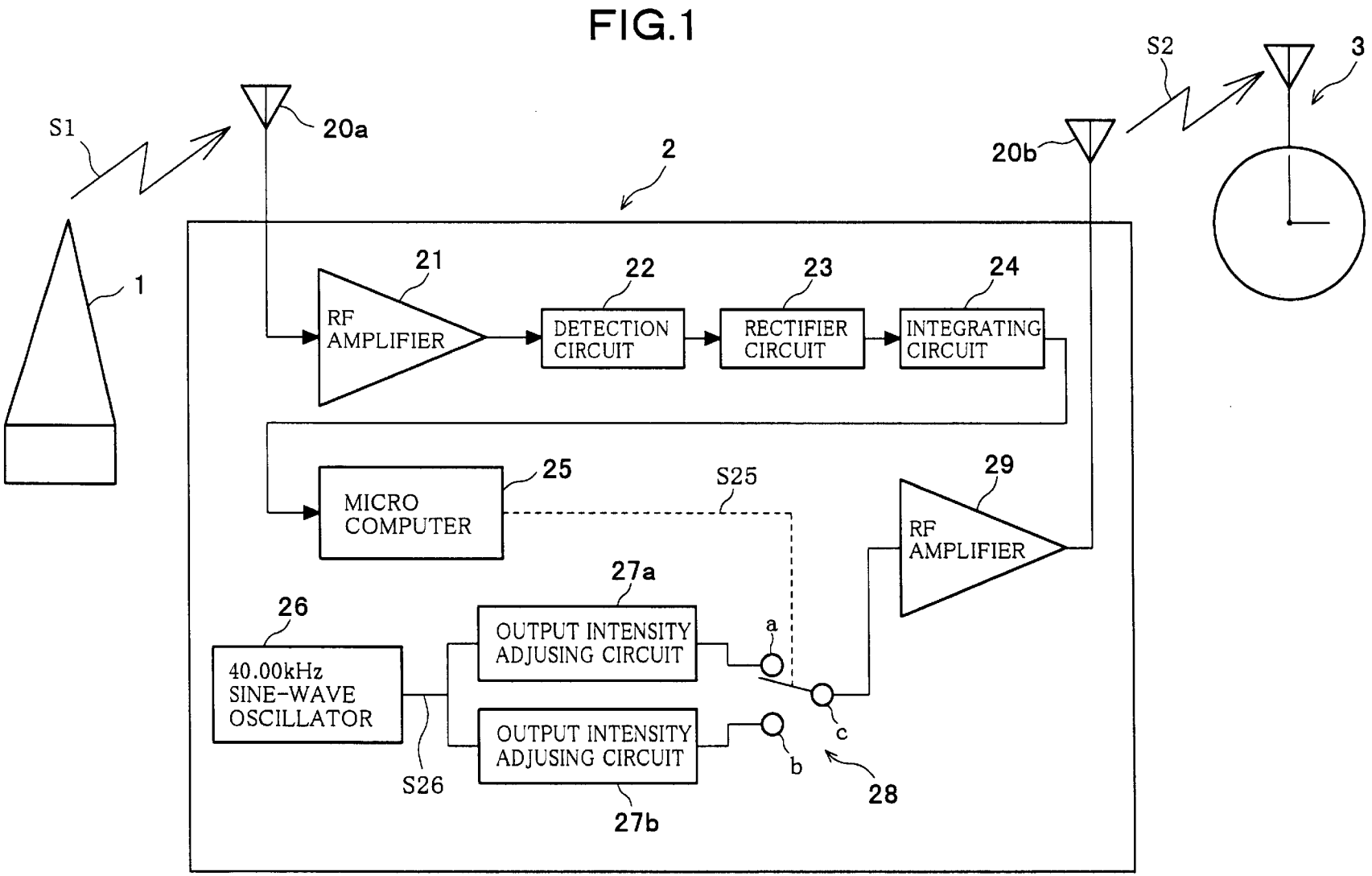
FIG. 1 is a block diagram of an embodiment of a time correction system using a time signal repeater according to the present invention.

FIG. 1 is a block diagram of an embodiment of a time correction system using a time signal repeater according to the present invention.

As shown in FIG. 1, the present time correction system is comprised of a radio transmission base station (hereinafter referred to as a "key station") 1 which transmits a standard time radio signal (JG2AS) with a long wave (40 kHz), a time signal repeater 2, and a radio correction clock 3.

Figure 2A:
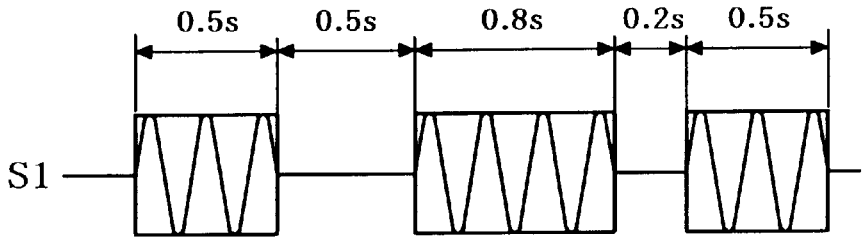
FIGS. 2A and 2B are views of principal waveforms of a time correction system using a time signal repeater according to the present invention.

The key station 1 performs amplitude modulation with respect to and transmits the long wave (40 kHz) standard time radio signal Si of the format, as shown in FIG. 2A.

The format of the long wave (40 kHz) standard time radio signal S1 sent by the key station 1 and transmitting the standard time at a high precision is specifically, in the case of a "1" signal, a signal of 40 kHz transmitted for a period of 500 ms (0.5 second) in one second, in the case of a "0" signal, a signal of 40 kHz transmitted for a period of 800 ms (0.8 second) in one second, and in the case of a "P" signal (synchronizing signal), a signal of 40 kHz transmitted for a period of 200 ms (0.2 second) in one second.

FIG. 2A shows an example of a waveform in the case where the data is (1,0,1).

FIG. 3 shows an example of the time code of a standard time radio signal.

The long wave standard radio signal used presently in Japan is transmitted from a station in Fukushima prefecture operated by the Communications Research Laboratory (CRL) of the Ministry of Posts and Telecommunications. The transmitted information is constituted by the "minutes", "hour", and total days from January 1.

The time data is transmitted at 1 bit/sec with one minute being designated as one frame. The information of the "minutes", "hour", and total days from January 1 as mentioned above is provided in the frame by a BCD code. Further, the transmitted data includes a marker called a "P code" in addition to "0's" and "1's". There are several P codes in one frame. They appear at the exact minute (0 second) and at 9 seconds, 19 seconds, 29 seconds, 39 seconds, 49 seconds, and 59 seconds. The P code successively appears only once in one frame at only 59 seconds and 0 second. The position where it successively appears becomes the exact minute position. The "minute" and "hour" data and other time data are obtained from fixed positions in a frame based on this exact minute position, so if the exact minute position cannot be detected, the time data cannot be obtained.

Next, the long wave standard radio signal will be explained.

Figures 3A, 3B, 3C:
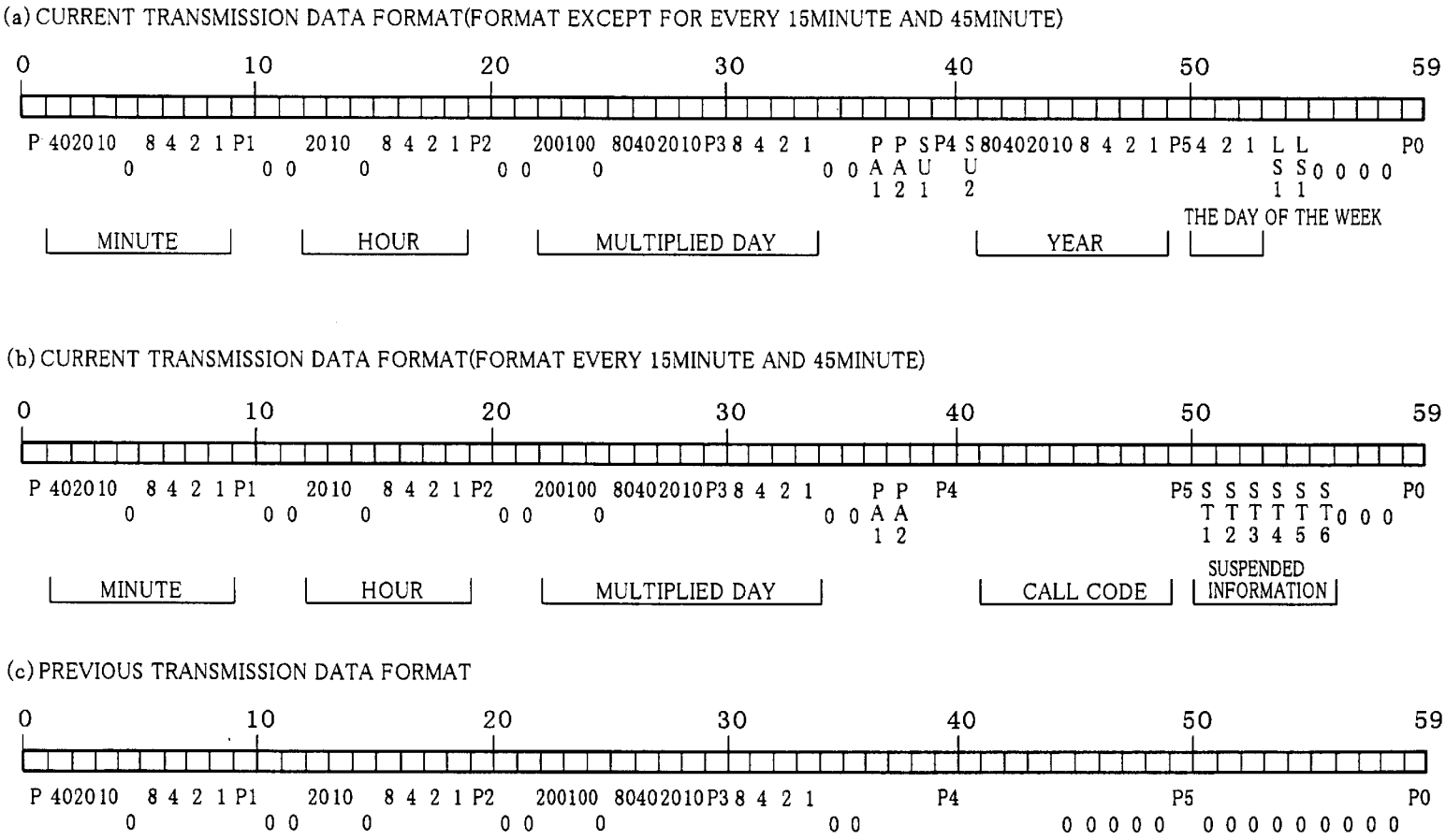
FIGS. 3A, 3B and 3C are views of an example of a time code of a standard time radio signal S1.

The current standard radio signal includes, in addition to the previous transmitted data (at the time of the experimental station), the last two digits of the year, the day of the week, minute parity, second parity, spare use bits planned to be used at the time of introduction of daylight saving time, and a leap second (refer to FIG. 3A). Suspended transmission information for stopping the transmission of the radio signal is also added at every 15 minutes and 45 minutes (refer to FIG. 3B). Below, the spare use bits, leap second information, and the suspended transmission information among the newly provided information will be explained.

For the spare use bits, SU1 and SU2 are used as shown in Table 1. These are provided for further expansion of information. When these bits are used for daylight savings time information, the information will be provided in the form of "No change to daylight savings time coming in next 6 days" when SU1 and SU2 are 0, "Change to daylight savings time coming in next 6 days" when SU1 is 1 and SU2 is 0, "Daylight savings underway" when SU1 is 0 and SU2 is 2, and "Daylight savings time finishing in next 6 days" when SU1 and SU2 are 1. Japan has not yet introduced daylight savings time for the summer months so what will happen is still unclear, but most European countries switch over to daylight savings time during the night.

TABLE 1

| Spare Use Bits (Example of Use for Daylight Savings Time) | | |
|---|---|---|
| SU1 | SU2 | Meaning |
| 0 | 0 | No change to daylight savings time coming in next 6 days |
| 1 | 0 | Change to daylight savings time coming in next 6 days |
| 0 | 1 | Daylight savings time underway (no change from daylight savings time to normal time coming in next 6 days) |
| 1 | 1 | Daylight savings time finishing in next 6 days |

Next, for the leap second, the 2 bits LS1 and LS2 are used as shown in Table 2. The information is provided in the form of "No leap second correction coming in next month" when LS1 and LS2 are 0, "Negative leap second (deletion) coming in next month" when LS1 and LS2 are 0, that is, one minute becoming 59 seconds, and "Positive leap second (insertion) coming in next month" when LS1 and LS2 are 1, that is, one minute becoming 61 seconds. The timings of leap second corrections are already determined. The corrections are made right before January 1 or July 1 of the UTC (Temps Universel Coordonne (Coordinated Universal Time)) time. Therefore, the corrections are made right before 9:00 am of January 1 or July 1 in Japan time (JTC).

TABLE 2

| Leap Seconds | | |
|---|---|---|
| LS1 | LS2 | Meaning |
| 0 | 0 | No leap second coming in next month |
| 1 | 1 | Leap second coming in next month (insertion) |
| 1 | 0 | Leap second coming in next month (deletion) |

For the suspended transmission information, ST1, ST2, ST3, ST4, ST5, and ST6 are used as shown in Tables 3A, 3B, and 3C. Advance notice of the start of suspended transmission is provided by ST1, ST2, and ST3, advance notice of the time band of suspended transmission by ST4, and advance notice of the duration of the suspended transmission by ST5 and ST6. Explaining first the advance notice of the start of suspended transmission, the information is provided in the form of "No suspended transmission scheduled" when ST1, ST2, and ST3 are 0, "Suspended transmission coming in next 7 days" when ST1 and ST2 are 0 and ST3 is 1, "Suspended transmission coming in next 3 to 6 days" when ST1 is 0, ST2 is 1, and ST3 is 0, "Suspended transmission coming in next 2 days" when ST1 is 0 and ST2 and ST3 are 1, "Suspended transmission coming in next 24 hours" when ST1 is 1 and ST2 and ST3 are 0, "Suspended transmission coming in next 12 hours" when ST1 is 1, ST2 is 0, and ST3 is 1, and "Suspended transmission coming in next 2 hours" when ST1 and ST2 are 1 and ST3 is 0. Next, the advance notice of the time band of suspended transmission is given as "Only daytime" when ST4 is 1 and "all day or no suspended transmission scheduled" when ST4 is 0. Next, the advance notice of the duration of the suspended transmission is given as "No suspended transmission scheduled" when ST5 and ST6 are 0, "Suspended transmission for more than 7 days or undetermined duration" when ST5 is 0 and ST6 is 1, "Suspended transmission for 2 to 6 days" when ST5 is 1 and ST6 is 0, and "Suspended transmission less than 2 days" when ST5 and ST6 are 1.

TABLE 3A

| Suspended Transmission Information | | | |
|---|---|---|---|
| ST1 | ST2 | ST3 | Meaning |
| 0 | 0 | 0 | No suspended transmission scheduled |
| 0 | 0 | 0 | Suspended transmission coming in next 7 days |
| 0 | 1 | 0 | Coming in next 3 to 6 days |
| 0 | 1 | 1 | Coming in next 2 days |
| 1 | 0 | 0 | Coming in next 24 hours |
| 1 | 0 | 1 | Coming in next 12 hours |
| 1 | 1 | 0 | Coming in next 2 hours |

TABLE 3B

| ST4 | Meaning |
|---|---|
| 0 | All day or no suspended transmission scheduled |
| 1 | Suspended transmission only daytime |

TABLE 3C

| ST5 | ST6 | Meaning |
|---|---|---|
| 0 | 0 | No suspended transmission scheduled |
| 0 | 1 | More than 7 days or undetermined duration |
| 1 | 0 | 2 to 6 days |
| 1 | 1 | Less than 2 days |

As explained above, the information containing the standard time information transmitted by the long wave radio signal by the Communications Research Laboratory (CRL) of the Ministry of Posts and Telecommunications includes information by the spare use bits, leap second information, and suspended transmission information in addition to the standard time information.

The time signal repeater 2 receives the standard time radio signal S1 including the time code and having a predetermined frequency (for example, 40 kHz) amplitude modulated and transmitted from the key station 1, corrects the internal clock to the time according to the time code included in the received standard time radio signal, generates a time radio signal S2*a* of the first intensity and a time radio signal S2*b* of the second intensity different of the first intensity having a frequency of 40 kHz included in the same frequency band of the standard time radio signal, having the same format as a baseband signal, and including a time code based on the corrected internal clock, and transmits the same to the radio correction clock 3 placed, for example, a close place or far place of indoors in predetermined first and second transmission time bands.

In this embodiment, for example, the first time is set to 2:38 am and the second time is set to 2:48 am.

The first intensity of the time radio signal S2*a* transmitted at the first time is −20 to −30 dB, while the second intensity of the time radio signal S2*b* transmitted at the second time is −3 dB larger than the time radio signal S2*a* transmitted at the first time.

Specifically, as shown in FIG. 1, the time signal repeater 2 is configured by a receiving antenna 20*a*, a transmission antenna 20B, a reception use RF amplifier 21, a detection circuit 22, a rectifier circuit 23, an integrating circuit 24, a microcomputer 25 having a function as a control circuit, a sine-wave oscillator 26 of which an oscillating frequency is 40 kHz, output intensity adjusting circuits 27*a* and 27*b*, an analog switch 28, and a transmission use RF amplifier 29. The reception circuit is configured by the receiving antenna 20*a*, the reception use RF amplifier 21, the detection circuit 22, the rectifier circuit 23, the integrating circuit 24, and the microcomputer 25, while the transmission circuit is configured by the microcomputer 25, a sine-wave oscillator 26, the output intensity adjusting circuits 27*a* and 27*b*, the analog switch 28, the transmission use RF amplifier 29, and the transmission antenna 20*b*.

Figure 2B:
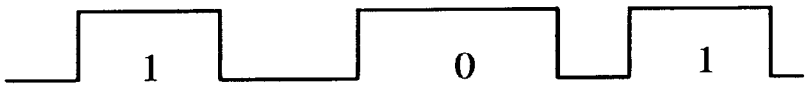

In the time signal repeater 2, the standard time radio signal S1 received by the receiving antenna 20*a* is converted to the baseband signal of the standard time radio signal S1 shown in FIG. 2B via the reception use RF amplifier 21, the detection circuit 22, the rectifier circuit 23, and the integrating circuit 24 and input to the microcomputer 25.

Figure 4:
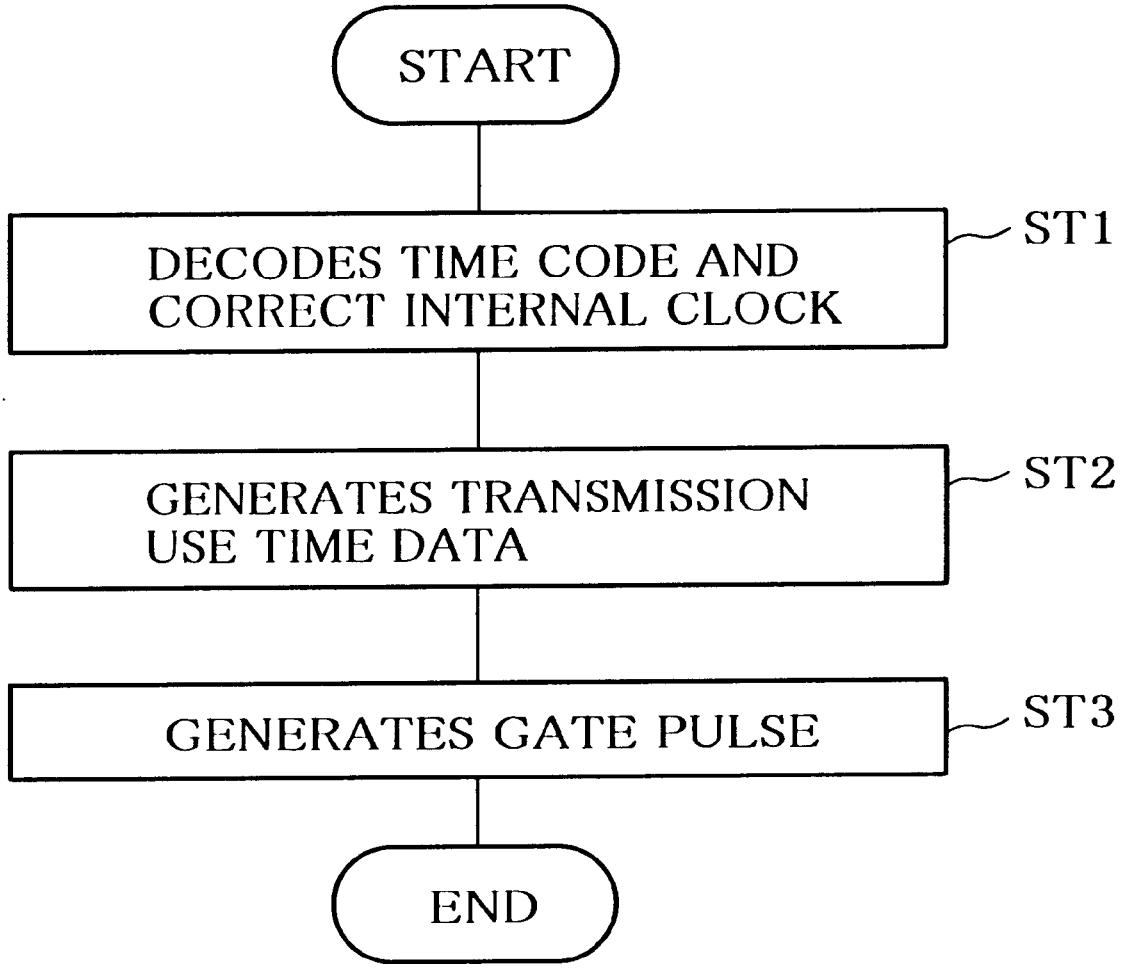
FIG. 4 is a flowchart for explaining an outline of processing of a microcomputer in a time signal repeater according to the present invention.

As shown in the flowchart of FIG. 4, the microcomputer 25 receives the baseband signal from the integrating circuit 24, decodes the time code, obtains the time data, for example, the hour:minute:00 second, and corrects the internal clock (ST1) accordingly.

Next, the microcomputer 25 generates the time data to be transmitted based on the time which the internal clock is counting in the predetermined first transmission time band, for example, at 2:38 a.m. and the second transmission time band, for example at 2:48 am. (ST2).

Then, the microcomputer 25 outputs the time data of the same format as the baseband signal to a control terminal of the analog switch 28 as a gate pulse S25 (ST3), makes the analog switch 28 generate time radio signals S2*a* and S2*b*, and makes the transmission use RF amplifier 211 transmit the same to the radio correction clock 3.

The output intensity adjusting circuit 27*a* prevents a radio correction clock 3 set at a very close distance from the time signal repeater 2 from being unable to normally receive the time radio signal from the time signal repeater because the field intensity is too large and input saturation occurs by adjusting an output level of an oscillating signal S26 generated from the sine-wave generator 26 so that the field intensity of the time radio signal S2*a* transmitted from the transmission antenna 20*b* becomes the first intensity, for example, −20 to −30 dB, and outputting the same to a terminal a of the analog switch 28.

The output intensity adjusting circuit 27*b* prevents a radio correction clock 3 set at a place relatively far from the time signal repeater 2 from being unable to normally receive the time radio signal from the time signal repeater because the field intensity is too small by adjusting the output level of the oscillating signal S26 generated from the sine-wave generator 26 so that the field intensity of the time radio signal S2*b* transmitted from the transmission antenna 20*b* becomes the second intensity larger than the first intensity, for example, −3 dB, and outputting the same to the terminal b of the analog switch 28.

The analog switch 28 is controlled so that an output terminal c is connected to an input terminal a at the first transmission time band and the output terminal c is connected to the input terminal a at the second transmission time band. The output intensity adjusting circuit 27*a* and output intensity adjusting circuit 27*b* make the oscillating signal S26 adjusted the level and oscillated from the sine-wave oscillator 26 ON/OFF by the gate pulse S25 from the microcomputer 25 to obtain an amplitude modulated RF signal.

The amplitude modulated RF signal is amplified by the transmission use RF amplifier 29 and transmitted from the transmission antenna 20*b* as the radio signals S2*a* and S2*b* having the same format shown in FIG. 2A.

Note that it is possible to configure the time signal repeater 2 so as to transmit the radio signals S2*a* and S2*b* at a predetermined interval a whole day, however, in the present embodiment, considering the use under a buttery source and the radio interference with the standard time radio signal, the time signal repeater 2 is configured so as to transmit the radio signal one time a day only at a very special time, for example, at 2:38 a.m. and at 2:48 a.m.

Figure 5:
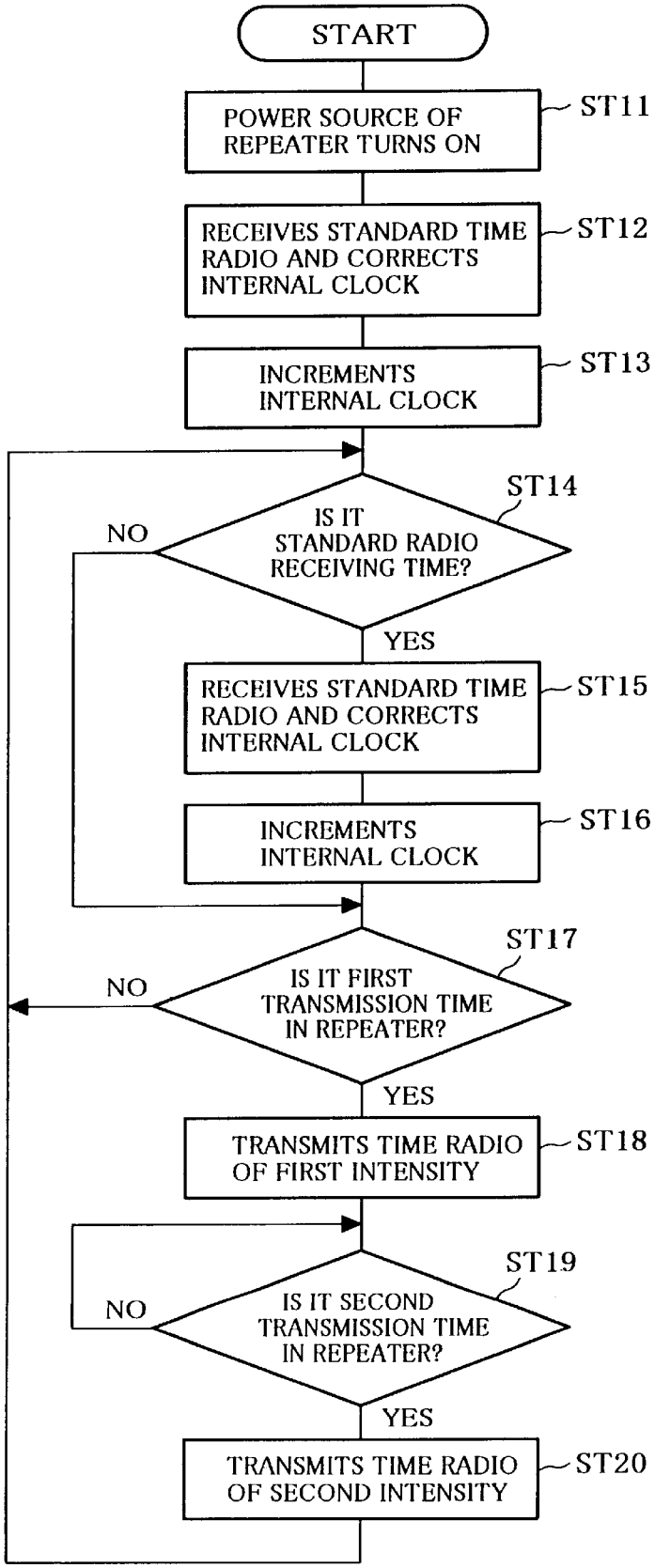
FIG. 5 is a flowchart for explaining a whole operation in a time signal repeater according to the present invention.

FIG. 5 is a flowchart for explaining the overall operation in the time signal repeater 2 according to the present embodiment.

As shown in FIG. 5, when the power is turned on, the time signal repeater 2 receives the standard time radio signal S1. The microcomputer 25 corrects the internal clock (ST11, ST12) and increments the internal clock (ST13).

Note that "the microcomputer increments the internal clock" means the clock provided inside the time signal repeater 2 (a program clock of the microcomputer 25 etc.) counts the time based on the received time data.

Next, the time signal repeater 2 judges whether the time is a time for receiving the standard time radio signal S1, for example, 2:36 am, or not (ST14). When it is the time to reception, it receives the standard time radio signal S1, corrects the internal clock, and increments the internal clock (ST15, ST16)

Next, the time signal repeater 2 judges whether the time is a first transmission time of the time radio signal, for example, 2:38 am, or not (ST17). When it is the transmission time, it transmits the time radio signal S2*a* of the first intensity (ST18).

Then, the time signal repeater 2 judges whether the time is the second transmission time of the time radio signal, for example, 2:48 am (ST19). When it is the transmission time, it transmits the time radio signal S2*b* (ST20) of the second intensity.

In principal, the radio correction clock 3 receives the predetermined frequency (40 kHz) standard time radio signal S1 including the time code amplitude modulated and transmitted from the key station 1 or the 40 kHz frequency time radio signals S2*a* and S2*b* transmitted from the time signal repeater 2, corrects the positions of the hands to the time indicated by the time code when the reception state of the standard time radio signal S1 or the time radio signals S2*a* and S2*b* are good, while informs the user of the poor reception of the radio signal when the reception state of the same is not good.

Note that the radio correction clock 3 decodes the time radio signal S2*a* of the first intensity transmitted from the time signal repeater 2 at the first time, when it is possible to convert the decoded result to the time data, corrects the positions of the hands to positions according to the decoded time. In this case, the radio correction clock 3 does not receive the time radio signal S2*b* of the second intensity transmitted at the second time.

On the other hand, the radio correction clock 3 decodes the first time radio signal S2*a* of the first intensity transmitted from the time signal repeater 2 at the first time, when it is impossible to convert the decoded result to the time data, does not correct the positions of the hands, and receives the second time radio signal S2*b* of the second intensity transmitted at the second time.

Figure 6:
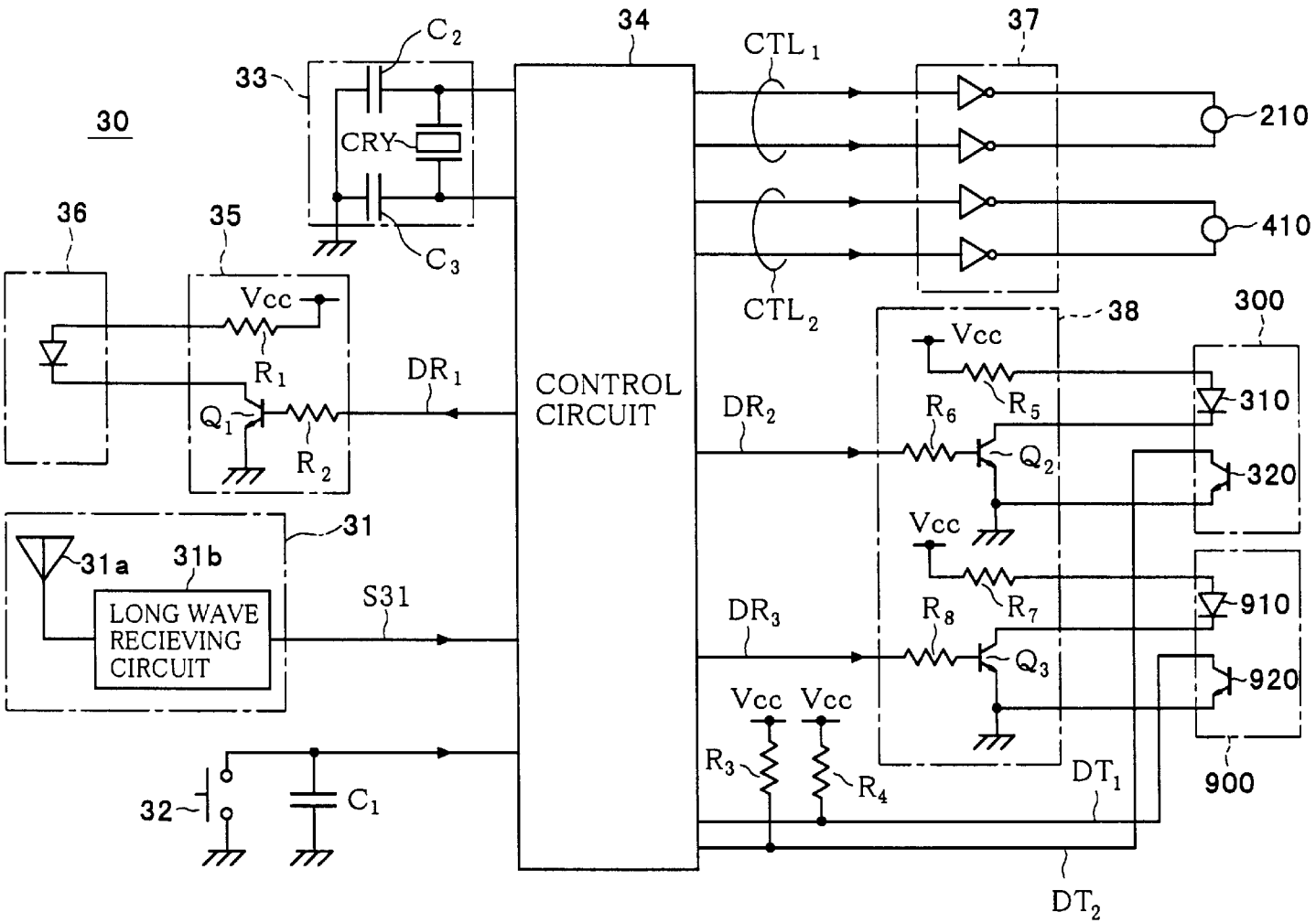
FIG. 6 is a block diagram of the configuration of an embodiment of a signal processing circuit of a radio correction clock according to the present invention.
Figure 7:
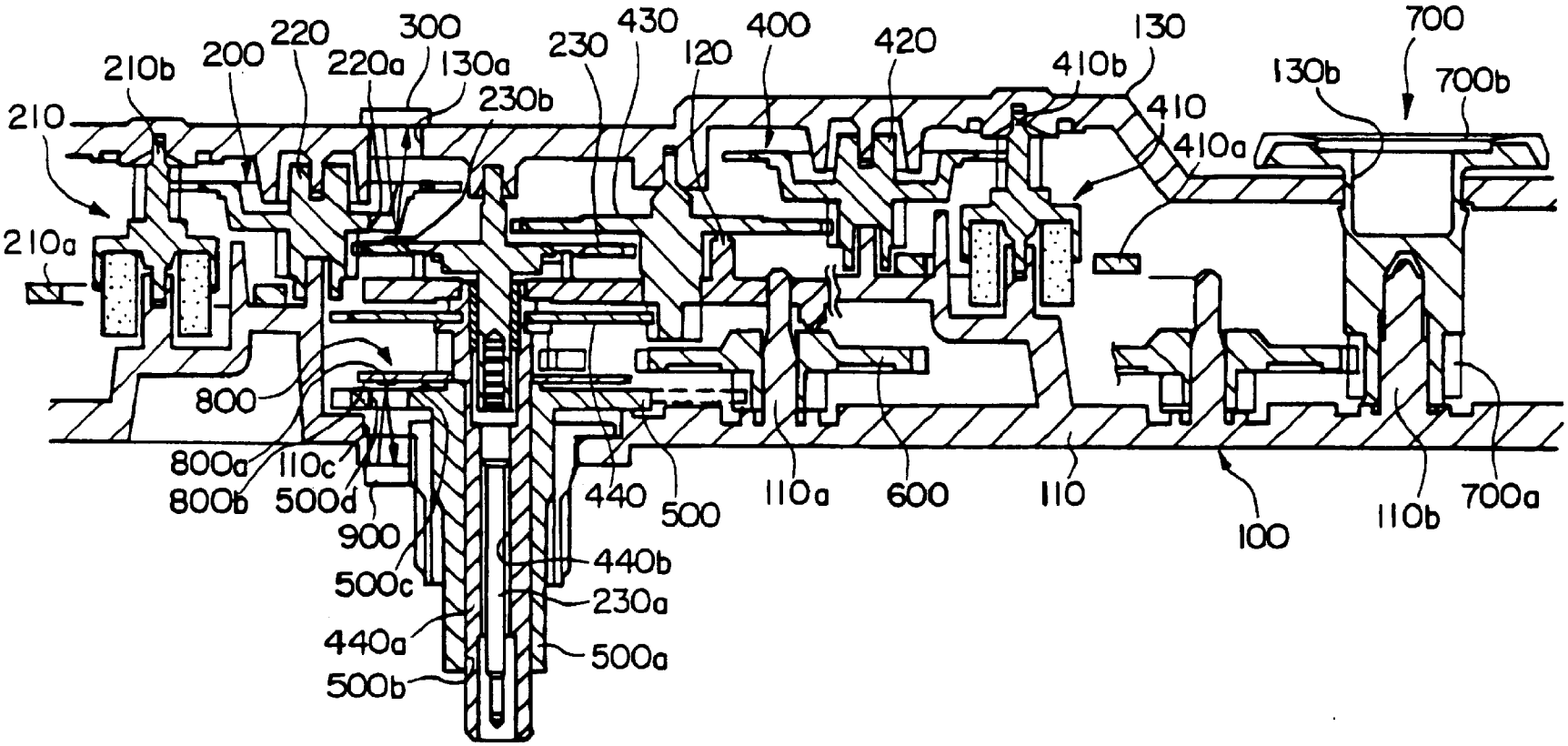
FIG. 7 is a sectional view of an embodiment of a hand position detecting apparatus of a radio correction clock according to the present invention.
Figure 8:
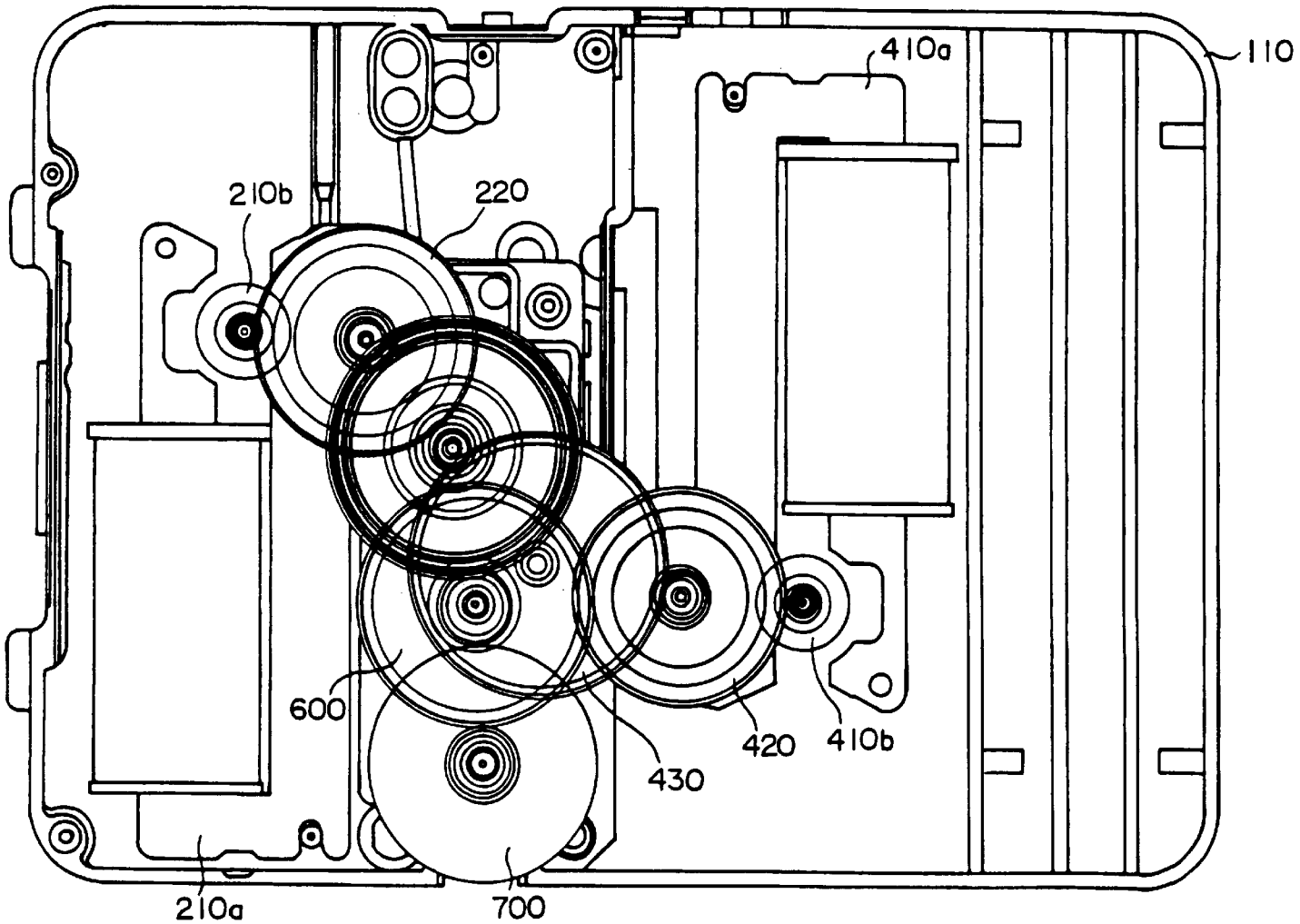
FIG. 8 is a principal plane view of a hand position detecting apparatus of a radio correction clock according to the present invention.

FIG. 6 is a block diagram of the configuration of an embodiment of the signal processing circuit of the radio correction clock according to the present invention, FIG. 7 is a sectional view of an embodiment of a hand position detecting apparatus of the radio correction clock according to the present invention, and FIG. 8 is a principal plane view of the hand position detecting apparatus of the radio correction clock according to the present invention.

In the figures, 30 denotes a signal processing circuit, 31 denotes a time radio signal receiving system, 32 denotes a reset switch, 33 denotes an oscillating circuit, 34 denotes a control circuit, 35 denotes a drive circuit, 36 denotes a light emitting element functioning as a warning means, 37 denotes a buffer circuit, 38 denotes a drive circuit, Vcc denotes a power source voltage, $C_1$ to $C_3$ denote capacitors, $R_1$, to $R_8$ denote resistance elements, 100 denotes a clock body, 200 denotes a second hand driving system, 300 denotes a first reflection type optical sensor, 400 denotes a minute hand driving system, 500 denotes an hour hand wheel, 600 denotes a minute (changing) wheel functioning as an intermediate wheel, 700 denotes a manual correction shaft, 800 denotes a rotary detection plate, and 900 denotes a second reflection type optical sensor.

The time radio signal receiving system 31 is configured by a receiving antenna 31*a* and a long wave receiving circuit 31*b* which receives a long wave (for example 40 kHz) including a time code signal transmitted, for example, by the key station 1, performs predetermined signal processing, and outputs the same as a pulse signal S31 to the control circuit 34. Note that, though not illustrated here, the long wave receiving circuit 31*b* is constituted by an RF amplifier, a detection circuit, a rectifier circuit, and an integrating circuit in the same way as the receiving system of the time signal repeater.

The reset switch 32 is turned on when the different states of the control circuit are returned to the initial state.

When the reset switch 32 is turned on or a not illustrated battery is set, the radio correction clock 3 enters an initial correction mode.

The oscillating circuit 33 is constituted by a crystal oscillator CRY and capacitors $C_2$ and $C_3$ and supplies a basic clock having a predetermined frequency to the control circuit 34.

The control circuit 34 has a not illustrated minute hand counter, second hand counter, standard minute and second counter, and the like. At the initial correction mode, the control circuit 34 receives the pulse signal S31 from the time radio signal receiving system 31 and for example compares a reception state of the received standard time radio signal with a predetermined reference range. When the reception state is within the reference range, the control circuit 34 outputs control signals $CTL_1$ and $CTL_2$ to a second hand use stepping motor 210 and an hour hand and minute hand use stepping motor 410 via the buffer 37 to initially set the positions of the hands. When the reception state is outside the reference range, the control circuit 34 outputs a driving signal $DR_1$ to the drive circuit 35, without outputting the control signals $CTL_1$ and $CTL_2$, to cause the light emitting element 36 serving as the warning means to emit light and inform the user that reception of the radio signal is almost impossible.

Further, when the reception state is within the reference range, the control circuit 34 decodes the received radio signal. When the result of the decoding is that it is possible to convert the same to time date, in other words, to reproduce the time data, it controls the count operations of the different counters based on the basic clock from the oscillating circuit 33 and outputs the control signals $CTL_1$ and $CTL_2$ to the second hand use stepping motor 210 and the hour hand and minute hand use stepping motor 410 via the buffer 37 according to the input levels of the detecting signals $DT_1$, and $DT_2$ from the first and second reflection type optical sensors 300 and 900 in order to control the rotation and thereby controls the correction of the time.

On the other hand, when the result of the decoding is that it is impossible to convert the same to time data, the control circuit 34 outputs the driving signal $DR_1$, to the drive circuit 35 , without outputting the control signals $CTL_1$ and $CTL_2$, to cause the light emitting element 36 to emit light and inform the user of poor reception of the radio signal.

By this, the control circuit 34 completes the operation of the initial correction mode.

Further, the control circuit 34 controls the operation of the normal correction mode after completing the operation of the initial correction mode.

In the normal correction mode, the control circuit 34 makes a not illustrated power source supply driving power to the time radio signal receiving system 31 one minute before and after every hour, including the exact hour, so as to enable the reception of the hourly standard time radio signal S1 from the key station 1. Also, the control circuit 34 makes the not illustrated power source supply driving power to the time radio signal receiving system 31 one minute before and after 2:38 a.m., including 2:38 a.m., so as to enable reception of the time radio signal S2*a* of the first intensity from the time signal repeater 2.

The control circuit 34 decodes the time radio signal S2*a* of the first intensity transmitted from the time signal repeater 2 at the first time, when it is possible to convert the decoded result to the time data, correct the positions of the hands to positions according to the decoded time.

In this case, the radio correction clock 3 does not receive the second time radio signal S2*b* of the second intensity transmitted from the time signal repeater 2 at the second time. Namely, the control circuit 34 does not make the not illustrated power source supply driving power to the time radio signal receiving system 31 for one minute before and after 2:48 am, including 2:48 am.

On the other hand, the control circuit 34 decodes the time radio signal S2*a* of the first intensity transmitted from the time signal repeater 2 at the first time, when it is impossible to convert the decoded result to the time data, does not correct the positions of the hands, but the control circuit 34 makes the not illustrated power source supply driving power to the time radio signal receiving system 31 for one minute before and after 2:48 am, including 2:48 am, so as to enable reception of the time radio signal S2*b* of the second intensity transmitted at the second time.

Then the control circuit 34 decodes the time radio signal S2*b* of the second intensity transmitted from the time signal repeater 2 at the second time and, when it is possible to convert the decoded result to the time data, corrects the positions of the hands to positions according to the decoded time.

In this way, the control circuit 34 controls a receivable time band of the standard time radio signal S1 from the key station 1 and a receivable time band of the radio signals S2*a* and S2*b* from the time signal repeater 2 to different times so as that for example the radio signals S2*a* and S2*b* from the time signal repeater 2 does not become radio interference when the standard time radio signal S1 is received.

At the normal correction mode, in principal, the control circuit 34 receives the standard time radio signal S1 from the key station 1 and decodes the received radio signal. When the result of the decoding is that it is possible to convert the same to time data, it controls the count operations of the different counters based on the basic clock from the oscillating circuit 33 and outputs the control signals $CTL_1$ and $CTL_2$ to the second hand use stepping motor 210 and the hour hand and minute hand use stepping motor 410 via the buffer 37 according to the input levels of the detecting signals $DT_1$ and $DT_2$ from the first and record reflection type optical sensors 300 and 900 in order to control the rotation and thereby controls the correction of the time. It also sets a standard radio signal normal reception flag showing that the standard time radio signal has been normally received.

When setting the standard radio signal normal reception flag, the control circuit 34 does not receive the time radio signal S2*a* from the time signal repeater 2, namely does not make the not illustrated power source supply the driving power to the standard radio signal receiving system 31 one minute before and after 2:38 a.m., including 2:38 a.m., while resets the standard radio signal normal reception flag, receives the hourly standard time radio signal S1 from the key station 1 , and corrects the time.

On the other hand, when the result of the decoding is that it is impossible to convert the same to time data, the control circuit 34 outputs, for example, the driving signal $DR_1$ to the drive circuit 35, without outputting the control signals $CTL_1$ and $CTL_2$, to cause the light emitting element 36 serving as the warning means to emit light and inform the user of poor reception of the radio signal.

In this case, as mentioned above, the control circuit 34 receives the time radio signal S2*a* from the time signal repeater 2.When the reception is normal, it corrects the time according to the time code of the time radio signal S2*a* obtained by the decoding.

When the reception is not normal, the control circuit 34 considers the place where the time signal repeater 2 placed to be unsuitable and outputs for example the driving signal $DR_1$ to the drive circuit 35, without outputting the control signals $CTL_1$ and $CTL_2$, to cause the light emitting element 36 serving as the warning means emit light to inform the user.

When it is impossible to convert the decoded result to the time data based on the time radio signal S2*a*, the control circuit 34 receives the time radio signal S2*b* transmitted at the second time as mentioned above. When it is impossible to convert the decoded result to the time data based on the time radio signal S2*b* either, however, the control circuit 34 concludes that the place where the time signal repeater 2 is placed is unsuitable and outputs for example the driving signal $DR_1$ to the drive circuit 35, without outputting the control signals $CLT_1$, and $CLT_2$, to cause the light emitting element 36 serving as the warning means to emit light to inform the user.

After the completion of the time correction or when the reception of the time radio signal S2*b* from the time signal repeater 2 is not normal and the control circuit 34 makes the light emitting element 36 emit light to inform the user etc., the control circuit 34 resets the standard radio signal normal reception flag, receives the hourly standard time radio signal S1 from the key station 1, and returns to the time correction mode.

The drive circuit 35 is constituted by an npn type transistor Q1 and resistance elements $R_1$ and $R_2$.

The collector of the transistor Q1 is connected to a cathode of a light emitting element constituted by a light emitting diode, the emitter is grounded, and the base is connected to an output line of the driving signal $DR_1$ of the control circuit 34 via the resistance element $R_2$.

The resistance element $R_1$ is connected to a supply line of the power source voltage Vcc and an anode of the light emitting element 36.

Namely, the light emitting element 36 is connected to the drive circuit 35 so as to emit light when a high level driving signal $DR_1$ is output from the control circuit 34.

The drive circuit 38 is constituted by npn type transistors Q2 and Q3 and resistance elements $R_5$ to $R_8$.

As shown in FIG. 7, the clock body 100 has a center plate 120 arranged at the substantially center portion of the space formed by a lower plate 110 and an upper plate 130 in a state connected to the lower plate 110. The second hand driving system 200, the first reflection type optical sensor 300, the second driving system 400, the hour hand wheel 500, the minute (changing) wheel 600, the manual correction shaft 700, and the second reflection type optical sensor 900 are fixed or axially supported with respect to predetermined positions of the lower plate 110, the center plate 120, and the upper plate 130 inside of the space.

The second hand driving system 200 is configured by a first stepping motor 210, a first fifth-wheel 220, and a second hand wheel 230.

The first stepping motor 210 has a stator 210*a* placed on the lower plate 110 and has a rotor 210*b* axially supported with respect to the lower plate 110 and the upper plate 130. It is controlled in direction of rotation, angle of rotation, and speed of rotation based on the control signal $CTL_1$ output from the control circuit 34 input via the buffer 37.

The first fifth-wheel 220 is axially supported with respect to the lower plate 110 and the upper plate 130, has gear teeth meshed with the rotor 210*b* of the first stepping motor 210, and reduces the speed of the rotor 210 to a predetermined speed.

The first fifth-wheel 220 is configured so as to rotate once every for example 15 seconds and is formed with a slit 220*a* in part of the area overlapping the second hand wheel 230.

The second hand wheel 230 has one end of the shaft supported with respect to the upper plate 130 and has the other side passed through the center plate 120 toward the lower plate 110 and press-fit with a second hand shaft 230*a*.

The second hand shaft 230*a* is passed through an opening 440*b* of a minute hand pipe 440*a* passing through the lower plate 110 and projecting out to a surface side where the face of the clock is formed. A not illustrated second hand is attached to the tip of the pipe.

The second hand wheel 230 has a second hand pinion meshed with a pinion of the first fifth-wheel 220 so as to rotate once every 60 seconds.

Further, a light reflecting plane 230*b* is formed at part of an area of overlap of the first fifth-wheel 220 with the second hand wheel 230 so as to face the slit 220*a* formed on the first fifth-wheel 220.

The second hand driving system 220 is configured so that the second hand points to 12 when the light reflecting plane 230*b* faces the slit 220*a*, namely the two exactly match each other.

The first reflection type optical sensor 300 is provided with a light emitting element 310 constituted by a light emitting diode and a light receiving element 320 constituted by an npn type transistor in parallel and is arranged on the upper plate 130 so that a light emitting portion of the light emitting element 310 and a light receiving surface of the light receiving element 320 are near the plane formed by the light reflecting plane 230*b* of the second hand wheel 230 via the slit 130*a* formed in the upper plate 130 and further the slit 220*a* of the first fifth-wheel 220.

An anode of light emitting element 310 of the first reflection type optical sensor 300 is connected to one end of the resistance element $R_5$ of the drive circuit 38 having another end connected to a supply line of the power source voltage Vcc, while a cathode is connected to a collector of the driving transistor Q2 provided in the drive circuit 38.

The emitter of the driving transistor Q2 is grounded, and the base is connected to an output line of the driving signal $DR_2$ of the control circuit 34 via the resistance element $R_6$.

Namely, the light emitting element 310 is connected to the drive circuit 38 so as to emit light when a high level driving signal $DR_2$ is output from the control circuit 34.

The collector of the light receiving element 320 of the first reflection type optical sensor 300 is connected to the supply line of the power source voltage Vcc and the control circuit 34,while the emitter is grounded.

Namely, the light receiving element 320 inputs a low level detecting signal $DT_2$ to the control circuit 34 only when the light emitted from the light emitting element 310 reaches the second hand wheel 320 via the slits 130*a* and 220*a* and the light reflected by the light reflecting plane 230*b* is received via the slits 130*a* and 220*a*.

The minute hand driving system 400 is configured by a second stepping motor 410, a second fifth-wheel 420, a third wheel 430, and a minute hand wheel 440.

The second stepping motor 410 has a stator 410*a* placed on the lower plate 110, has a rotor 410*b* axially supported with respect to the lower plate 110 and the upper plate 130, and is controlled in direction of rotation, angle of rotation, and speed of rotation based on the control signal $CTL_2$ output from the control circuit 34 via the buffer 37.

The second fifth-wheel 420 is axially supported with respect to the lower plate 110 and the upper plate 130, has gear teeth meshed with the rotor 410*b* of the second stepping motor 410, and reduces the speed of the rotor 410*b* to a predetermined speed.

The third wheel 430 has one end of a shaft portion axially supported with respect to the upper plate 130, has the other end passed through the center plate 120, and has gear teeth meshed with a pinion of the second fifth-wheel 420.

The minute hand wheel 440 forms an approximate T-shape in cross-section with an opening 440*b* at its center, has one end of the minute hand pipe 440A axially supported at the center plate 120, and has the shaft portion of the other end passed through an opening 500*b* of an hour hand pipe 500*a* of the hour hand wheel 500 passing through the lower plate 110 and projecting to the surface where the face of the clock is formed. A not illustrated minute hand is attached to the tip of the pipe.

The minute hand wheel 440 is configured to rotate once every 60 minutes.

Further, the second hand shaft 230*a* is inserted through the opening 440*b* as mentioned above. The gear teeth mesh with a pinion of the third wheel 430.

The minute hand wheel 440 is provided with a so-called slip mechanism.

The hour hand wheel 500 forms an approximate T-shape in cross-section with an opening 500*b* at its center, has gear teeth provided in the clock body 100 and has an hour hand pipe 500*a* passed though the lower plate 110 and projecting to the face side of the clock. A not illustrated hour hand is attached to the tip of the pipe.

The hour hand wheel 500 is configured so as to rotate 30° every hour and once every 12 hours.

Further, the minute hand pipe 400*a* is inserted through the opening 500*b* as mentioned above.

The slits 500*d* serving as the first light transmitting portions are formed in the surface 500*c* of the hour hand wheel 500 facing the minute hand wheel 440.

Figure 9:
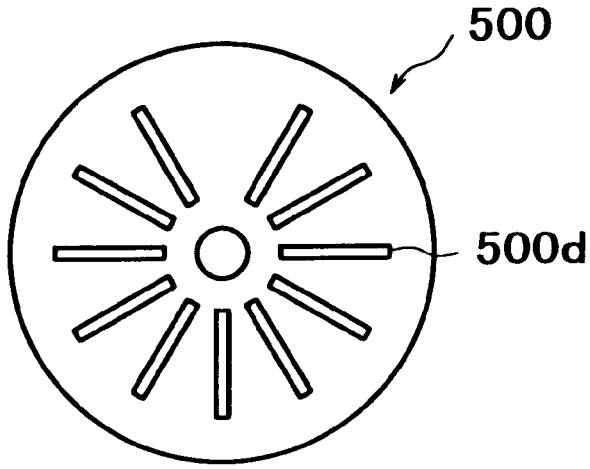
FIG. 9 is a view of an example of a pattern of a transparent hole of slits in an hour hand wheel according to the present invention.

As shown in FIG. 9, the slits 500*d* of the hour hand wheel 500 are formed in 11 locations, that is all but one location, in the 12 equally spaced locations 30° each apart in the circumferential direction of the hour hand wheel 500. Namely, the slits are formed so as not to detect a position of one hour among the 12 hours.

The minute (changing) wheel 600 is axially supported with respect to a projection portion 110*a* formed on the lower plate 110, has gear teeth meshed with the minute hand pipe 440*a* of the minute hand wheel 440, has a pinion meshed with the gear teeth of the hour hand wheel 500, reduces the speed of the minute hand wheel 440 to a predetermined speed, and transfers the rotation to the hour hand wheel 500.

Further, the minute wheel 600 is configured so as to rotate once every N (N is a positive integer) number of hours, has gear teeth meshed with a correction pinion 700*a* of the manual correction shaft 700, and is arranged so that part faces part of the rotary detection plate 800.

The manual correction shaft 700 forms an approximate T-shape in cross-section, has a correction pinion 700 a axially supported with respect to a projection formed on the lower plate 110 in the state passing through an opening 130*b* formed in the upper plate 130, and has a head portion 700*b* arranged in a state projecting out from the upper plate 130 to the outside of the clock body 100.

The manual correction shaft 700 is configured to rotate once every 60 minutes at the same phase as the minute hand wheel 440. As explained above, the correction pinion 700*a* meshes with the gear teeth of the minute wheel 600. When the minute hand wheel 440 is driven by the minute hand driving system 400, the shaft rotates at the same phase as the minute hand wheel 440 via the minute wheel 600. When the minute hand driving system 400 is not operating, the shaft enables manual correction of the positions of the hands by rotating the head portion 700*b*.

The rotary detection plate 800 forms a disk shape and is fixed at its center substantially coaxially with the shaft portion of the minute hand wheel 440*b* etween the minute hand wheel 440 and the hour hand wheel 500 so as to rotate according to the rotation of the minute hand wheel 440.

Figure 10:
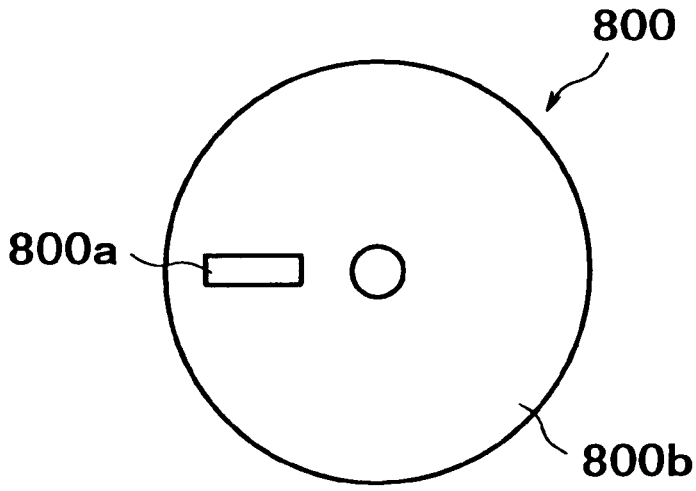
FIG. 10 is a view of an example of a pattern of formation of a light reflecting plane of a rotary detecting plate according to the present invention.

As shown in FIG. 10, a light reflecting plane 800*a* serving as a second light transmitting portion is formed at the part of an area of the rotary detection plate 800 overlapping the surface 500*a* of the hour hand wheel 500 so as to face the slit 500*d*.

The second reflection type optical sensor 900 is provided with a light emitting element 910 constituted by a light emitting diode and a light receiving element 920 constituted by an npn type transistor in parallel and is arranged on the lower plate 110 so that a light emitting portion of the light emitting element 910 and a light receiving surface of the light receiving element 920 are near the plane 800*b* formed by the light reflecting plane 800*a* of the rotary detection plate 800 via the slit 110*c* formed in the lower plate 110 and the slit 500*d* formed in the hour hand wheel 500.

An anode of the light emitting element 910 of the second reflection type optical sensor 900 is connected to one end of the resistance element $R_7$ of the drive circuit 38 having the other end connected to the supply line of the power source voltage Vcc, while a cathode is connected to a collector of the driving transistor Q3 provided in the drive circuit 38.

The emitter of the driving transistor Q3 is grounded, and the base is connected to an output line of the driving signal $DR_3$ of the control circuit 34 via the resistance element $R_6$.

Namely, the light emitting element 910 is connected to the drive circuit 38 so as to emit light when a high level driving signal $DR_3$ is output from the control circuit 34.

The collector of the light receiving element 920 of the second refection type optical sensor 900 is connected to the supply line of the power source voltage Vcc and the control circuit 34, and the emitter is grounded.

Namely, the light receiving element 920 inputs a low level detecting signal $DT_2$ to the control circuit 34 only when the light emitted from the light emitting element 910 reaches the surface 800*b* of the rotary detection plate 800 via the slit 500*d* and the light reflected by the light reflecting plane 800*a* is received via the slit 500*d*.

Note that the relationship between the light reflecting plane 800*a* of the rotary detection plate 800 and the slit 500*d* of the hour hand wheel 500 is set so as that the not illustrated minute hand and hour hand point to every hour when the light reflecting area 800*a* faces the slit 500*d*.

Next, an explanation will be made of the operation for control of time correction of the above configuration.

Note that, here, the explanation will be made taking as an example a normal mode operation of the minute hand system.

For example, the long wave (40 kHz) standard time radio signal S1 of the format for example as shown in FIG. 2A is amplitude modulated and transmitted from the key station 1.

In this state, the standard time radio signal S1 transmitted from the key station 1 is received by the receiving antenna 20*a* of the time signal repeater 2 and the receiving antenna 31*a* of the radio correction clock 3.

In the time signal repeater 2, the standard time radio signal S1 received by the receiving antenna 20*a* is converted to the baseband signal of the standard time radio signal S1 shown in FIG. 2B through the reception use RF amplifier 21, the detection circuit 22, the rectifier circuit 23, and the integrating circuit 24. The converted baseband signal is input to the microcomputer 25.

In the microcomputer 25, the baseband signal from the integrating circuit 24 is received, the time code is decoded to obtain time data such as the hour-minute-00 seconds, and the internal clock is corrected.

Further, at the predetermined first transmission time (for example, 2:38 a.m.) band and second transmission time (for example, 2:48 a.m.) band, the time data to be transmitted is generated based on a time counted by the internal clock.

Next, the time data is output to the control terminal of the analog switch 28 by the same format as the baseband signal as the gate pulse S25.

In the analog swatch 28, the output terminal c is connected to the input terminal a at the first transmission time band, while the output terminal c is connected to an input terminal b at the second transmission time band.

Therefore, the oscillating signal S26 generated from the sine-wave generator 26 and adjusted in level in the output intensity adjusting circuit 27*a* is turned on and off by the gate pulse S25 from the microcomputer 25 at the first transmission time band to obtain an amplitude modulated RF signal.

This amplitude modulated RF signal is amplified at the transmission use RF amplifier 29 and is transmitted from the transmission antenna 20*b* in the same way as the format shown in FIG. 2A as the time radio signal S2*a* of the first intensity.

Next, the oscillating signal S26 generated from the sine-wave generator 26 and adjusted in level at the output intensity adjusting circuit 27*b* is turned on and off by the gate pulse S25 from the microcomputer 25 at the second transmission time band to obtain the amplitude modulated RF signal.

This amplitude modulated RF signal is amplified at the transmission use RF amplifier 29 and is transmitted from the transmission antenna 20*b* in the same way the same as the format shown in FIG. 2A as the time radio signal S2*b* of the second intensity.

In the radio correction clock 3, the control circuit 34 makes a not illustrated power source supply driving power to the time radio signal receiving system 31 one minute before and after every hour, including the hour, to enable reception of the standard time radio signal S1 from the key station 1 at every hour.

Due to this, the long wave (for example 40 kHz) received by the receiving antenna 31*a* of the time radio signal receiving system 31 and including the time code signal transmitted from the key station 1 is subjected to predetermined signal processing at the long wave receiving circuit 31*b* and output to the control circuit 34 as the pulse signal S31.

In the control circuit 34, the received radio signal is decoded. When the result of the decoding is that reception is normal, control is performed to correct the time by controlling the counts of the different counters based on the basic clock from the oscillating circuit 33 and output of the control signals $CTL_1$ and $CTL_2$ to the second hand use stepping motor 210 and the hour and minute hand use stepping motor 410 via the buffer 37 according to the input levels of the detecting signals $DT_1$ and $DT_2$ from the first and second reflection type optical sensors 300 and 900 in order to control the rotation.

Next, the standard radio signal normal reception flag showing that the standard time radio signal has been normally received is set.

When the current time is not the receiving time of the standard time radio signal S1 or the reception is judged not normal or the standard radio signal normal reception flag has been set, it is judged if the current time is 2:38 a.m. (including one minute before and after) which is the receiving time of the time radio signal S2*a* from the time signal repeater 2 or not.

Here, when it is judged that the time is the receiving time of the time radio signal S2*a* and the standard radio signal normal reception flag has been set, driving power is not supplied from the not illustrated power source to the standard radio signal receiving system 31 one minute before and after 2:38 a.m., including 2:38 a.m. When the standard radio signal normal reception flag has been reset, the processing shifts to normal processing.

On the other hand, when the standard radio signal normal reception flag has not been set, the driving power is supplied from the not illustrated power source to the standard radio signal receiving system 31 one minute before and after 2:38 a.m., including 2:38 a.m., to enable reception of the time radio signal S2*a* from the time signal repeater 2.

At this time, when the reception is normal, control is performed to correct the time by controlling the counts of the different counters based on the basic clock from the oscillating circuit 33 and output of the control signals $CTL_1$ and $CTL_2$ to the second hand use stepping motor 210 and the hour and minute hand use stepping motor 410 via the buffer 37 according to the input levels of the detecting signals $DT_1$ and $DT_2$ from the first and second reflection type optical sensors 300 and 900 in order to control the rotation.

In this case, the radio correction clock 3 does not receive the time radio signal of the second intensity transmitted from the time signal repeater 2 at the second time since the radio correction clock 3 is set comparatively close to the time signal repeater 2 and can normally receive the time radio signal. That is, the control circuit 34 does not make the non-illustrated power source supply driving power to the time radio signal receiving system 31 for one minute before and after 2:48 am, including 2:48 am.

Further, when the result of the decoding of the time radio signal S2*a* of the first intensity transmitted from the time signal repeater 2 at the first time is that the time data cannot be obtained, the positions of the hands are not corrected, while the time radio signal S2*b* of the second intensity transmitted from at the second time is received. Namely, the driving power by the not illustrated power source is supplied to the time radio signal receiving system 31 for one minute before and after 2:48 am, including 2:48 am.

Then, when the result of the decoding of the time radio signal S2*b* of the second intensity transmitted from the time signal repeater 2 at the second time is that the time data can be obtained, control is performed to correct the time by controlling the counts of the different counters based on the basic clock from the oscillating circuit 33 and output of the control signals $CLT_1$ and $CLT_2$ to the second hand use stepping motor 210 and the hour and minute hand use stepping motor 410 via the buffer 37 according to the input levels of the detection signals $DT_1$ and $DT_2$ from the first and second reflection type optical sensors 300 and 900 in order to control the rotation.

In this case, the radio correction clock 3 is placed a long distance from the time signal repeater 2.

On the other hand, when the reception is not normal, it is considered that place where the time signal repeater 2 is placed is unsuitable, the driving signal $DR_1$ is output to the drive circuit 35, without outputting the control signals $CTL_1$ and $CTL_2$, and the light emitting element 36 emits light to inform the user.

As explained above, according to the present embodiment, since there is provided a time signal repeater 2 receiving a predetermined frequency (40 kHz) standard time radio signal S1 including a time code amplitude modulated and transmitted from a key station 1, correcting an internal clock to a time according to the time code included in the received standard time radio signal, and generating a time radio signal S2*a* of a first intensity and a time radio signal S2*b* of a second intensity different from the first intensity, each having a frequency of 40 kHz, included in the same frequency band of the standard time radio signal, having the same format as a baseband signal, and including a time code based on the corrected internal clock, and transmitting the same to a radio correction clock 3 placed close or far away at predetermined first and second transmission time bands, there is the advantage that complicated trouble is not necessary and the relayed radio signal can be received without regard as to the position where the radio correction clock is placed.

Further, since the time radio signal S2*a* with a weak intensity is transmitted at the first time and the time radio signal S2*b* with a strong intensity is transmitted at the second time, there is the advantage that when the radio correction clock 3 side can normally receive the time radio signal S2*a* and can correct the time, it is able to be made to not receive the time radio signal S2*b* transmitted after that at the second time and thereby receive signals with a good efficiency and realize a reduction in the power consumption.

Figure 11:
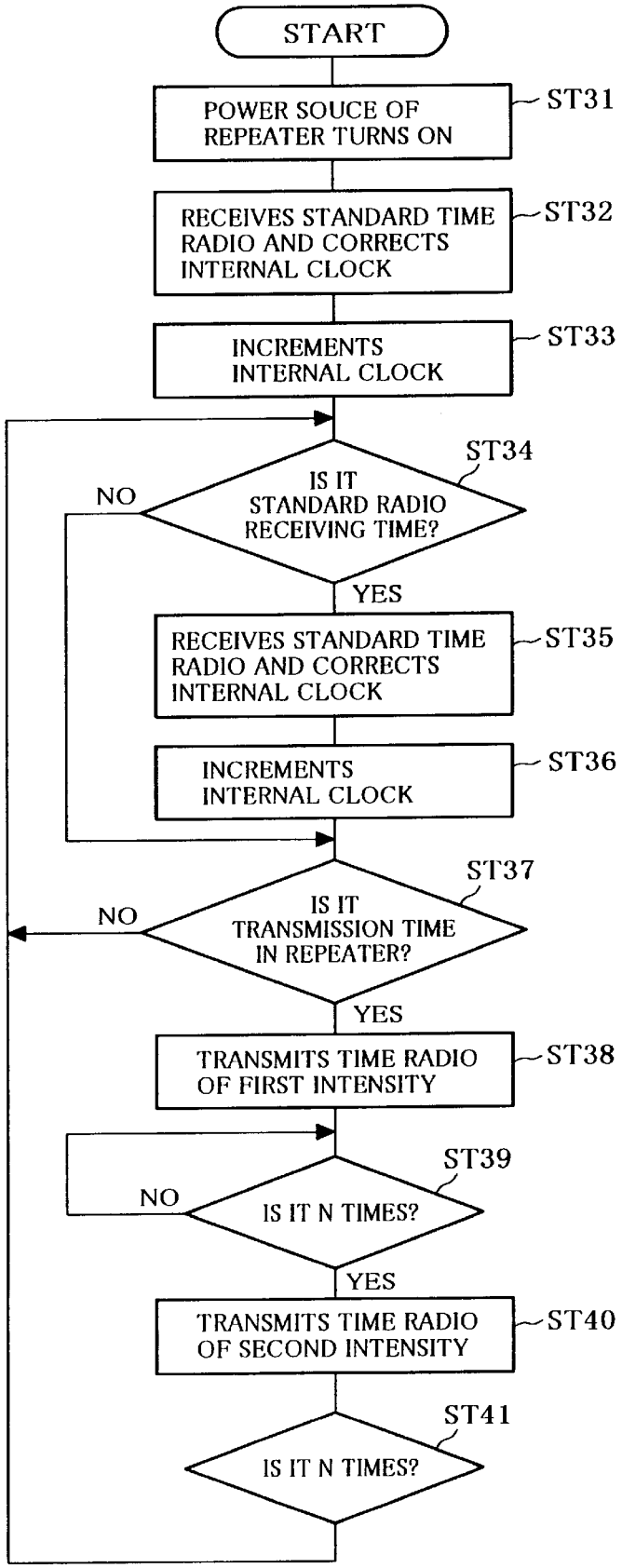
FIG. 11 is a flowchart for explaining an another embodiment of transmissions of radio signals of first and second intensities in the time signal repeater according to the present invention.

Note that, in this embodiment, the time signal repeater 2 sent signals separately in two times, that is, a transmission time of the time radio signals S2*a* with the first intensity and a transmission time of the time radio signal S2*b* with the second intensity. However, for example, as shown in FIG. 11, it is also possible to configure it to send data a plurality of times by a single transmission, send the time radio signal S2*a* of the first intensity several times, and then send the time radio signal S2*b* of the second intensity several times. In this case as well, the radio signals of the first intensity and the second intensity are transmitted at different time bands, but it is sufficient to manage a single transmission time as time management.

Specifically, as shown in FIG. 11, when the power is turned on, the time signal repeater 2 receives the standard time signal S1, and microcomputer 25 corrects the internal clock (ST31, ST32) and increments the internal clock (ST33).

Next, the time signal repeater 2 judges if the current time is the time for reception of the standard time radio signal S1, for example, 2:36 am (ST34). When it is judged that the time is the receiving time, the time signal repeater receives the standard time radio signal S1, corrects the internal clock, and increments the internal clock (ST35, ST36).

Next, the time signal repeater judges if the current time is the time for transmission of the time radio signal, for example, 2:38 am (ST37). When it is judged that the time is the transmission time, the time signal repeater continuously transmits (ST38, ST39) the time radio signal S2*a* of the first intensity N times.

After the time signal repeater transmits the time radio signal S2*a* of the first intensity N times, it transmits the time radio signal S2*b* of the second intensity N times (ST40, ST41).

Even if the transmission style is as above, there are the advantages that complicated trouble such as taking account of the directivity is not necessary and the relayed radio signal can be normally received as it is without regard as to the position where the radio correction clock is placed in the same way as mentioned above.

Also, when the radio correction clock 3 side can normally receive the time radio signal S2*a* and can correct the time, it is possible to have it not receive the time radio signal 2*b* transmitted at the second time and thereby receive the signal with a good efficiency and achieve a reduction in the power consumption.

Also, in the embodiment, since the control circuit 34 judges whether the time data can be obtained, corrects the positions of the hands when it can, and informs the user when it cannot by making the light emitting element 36 emit light, there is the advantage that it is possible to always recognize the state of reception of the radio signal at the time of operation.

Summarizing the effects of the inventions, as explained above, according to the present invention, there is the advantage that complicated trouble is not necessary and the repeated radio signal can be normally received without regard as to the position where the radio correction clock is arranged.

Also, since a time radio signal with a strong intensity at the first time is transmitted at a first time and then a time radio signal with a weak intensity is transmitted at a second time, there is the advantage that when the time corrected clock side can normally receive the time radio signal with the weak intensity and can correct the time, it may be made not to receive the time radio signal transmitted at the second time and thereby receive the signal with a good efficiency and achieve a reduction in the power consumption.

While the invention has been described with reference to a specific embodiment chosen for purpose of illustration, it should be apparent that numerous modifications could be made thereto by those skilled in the art without departing from the basic concept and scope of the invention.

What is claimed is:

1. A time signal repeater which relays a radio signal including a time code for a radio correction clock receiving a standard time radio signal to correct the time, comprising:

a reception circuit for receiving the standard time radio signal and correcting an internal clock to a time according to the time code included in the received radio signal and a transmission circuit for generating and transmitting time radio signals which have different intensities and include time codes based on the internal clock at a plurality of predetermined times.

2. A time signal repeater as set forth in claim 1, wherein the transmission circuit generates and transmits a time radio signal of a first intensity at a first time and generates and transmits a time radio signal of a second intensity at a second time.

3. A time correction system, comprising:

a radio correction clock for receiving a standard time radio signal or a radio signal obtained by relaying the standard time radio signal and correcting a time according to a time code included in the received signal and a time signal repeater which has a reception circuit for receiving the standard time radio signal and correcting an internal clock to a time according to the time code included in the received radio signal and a transmission circuit for generating and transmitting time radio signals which have different intensities and include time codes based on the internal clock at a plurality of predetermined times.

4. A time correction system as set forth in claim 3, wherein the transmission circuit generates and transmits a time radio signal of a first intensity at a first time and generates and transmits a time radio signal of a second intensity at a second time.

5. A time correction system as set forth claim 4, wherein the radio correction clock decodes the time radio signal of the first intensity transmitted from the time signal repeater at the first time and, when it is possible to obtain time data, corrects a time to a decoded time and does not receive the time radio signal of the second intensity transmitted at the second time, while when it is not possible to obtain time data, does not correct a time, but receives the time radio signal of the second intensity transmitted at the second time.

* * * * *